US006065695A

United States Patent [19]

Shimasaki

[11] Patent Number: 6,065,695

[45] Date of Patent: May 23, 2000

[54] DRY AND CRUSH TREATING METHOD USING JET BURNER AND TREATING APPARATUS THEREFOR

[76] Inventor: Tatsuaki Shimasaki, 3-8-20 Harimayacho, Kouchi-shi, Kouchi-ken, Japan

[21] Appl. No.: 09/186,020

[22] Filed: Nov. 4, 1998

[30] Foreign Application Priority Data

Jun. 12, 1998 [JP] Japan ..... P10-165543

[51] Int. Cl.[7] ..... B02C 19/06

[52] U.S. Cl. ..... 241/5; 241/39; 241/101.74; 241/65; 241/23

[58] Field of Search ..... 241/5, 39, 101.74, 241/65, 23

[56] References Cited

U.S. PATENT DOCUMENTS 3,741,485 6/1973 Gage et al. ..... 241/39

FOREIGN PATENT DOCUMENTS 11174 5/1968 Japan .
4935 2/1978 Japan .

*Primary Examiner*—Mark Rosenbaum
*Attorney, Agent, or Firm*—Jones & Askew

[57] ABSTRACT

A dry and crush treating apparatus using a jet burner, includes: a jet burner drying an oil-containing or/and water-containing raw material; a dry treating tank; and a recovering unit recovering a dried fine particles made of the raw material. In the construction, the recovering unit is installed within the dry treating tank.

3 Claims, 3 Drawing Sheets

DRY AND CRUSH TREATING METHOD USING JET BURNER AND TREATING APPARATUS THEREFOR

BACKGROUND OF THE INVENTION

1. Field of the Invention

The present invention relates to a dry and crush treating method using a jet burner and a treating apparatus therefor which can be used to re-convert into natural resources highly viscous organic and inorganic slurries, high water content industrial wastes such as a paper making sludge, organic high water content wastes such as foodstuff manufacture by-products, organic and inorganic mixtures such as shells, and oil-containing and water-containing materials (hereinafter referred to also as "raw material") such as oil sand, oil sludge, etc. by subjecting them to dry and crush treatment.

2. Description of the Related Art

With regard to a dry and crush treating apparatus using a jet burner, there have hitherto been made various proposals, in each of which however a gravity collector or cyclone for recovering solid matter is disposed separately and independently from a treating tank and each of which has a construction wherein relevant units are connected to each other by pipings (Refer for example to Japanese Patent Application Publication 53-4935).

For this reason, the piping and recovering unit are thermally insulated in order to prevent the heat radiation. However, the heat radiation cannot completely be prevented, with the result that a temperature drop naturally occurs from the treating tank toward a succeeding recovering unit. In a case where the temperature on the recovering unit side has been lowered down to a temperature lower than the temperature at which the oil and water contained in the raw material are gasified, there was the problem that the vapor and oil vapor which had been once vaporized within the treating tank was re-dewed. One method to prevent the occurrence of the re-dew is to elevate the treating temperature up to a temperature higher than the temperature needed to dry and thereby make the recovering unit side temperature higher than the dew point. Also, in some cases, there was adopted a method wherein the piping itself and recovering unit itself were heated so that the recovering unit side temperature might become higher than the dew point. In the former method, since the treating temperature is increased, the amount of treatment is decreased, raising the problem that the treating cost is increased or, in the case of an organic material, carbonization and thermal decomposition, etc. occur. In the latter method, a heat source for heating a material to be treated is separately needed and therefore there is the problem that the treating cost is increased.

Incidentally, as a conventional method, in order to dehydrate a hygroscopic material such as silicagel as completely as possible, solid matter particles are passed through an eddy of gas fluid and light-weight particles are passed through a second atmosphere as disclosed in Japanese Patent Application Publication No. 43-11174, whereby there is proposed a method of separating and recovering the particles. This method necessitates thermally insulating the recovered portion, raising the same problem as that encountered by the above-described conventional methods. In addition, it is needed to produce the first and second eddy currents, raising another problem that the method becomes complex.

SUMMARY OF THE INVENTION

The present invention has been achieved with such points in mind.

It therefore is an object of the present invention to provide a dry and crush treating method using a jet burner and a treating apparatus therefor where pipings can be drastically reduced, structure of the apparatus can be simplified, extra over heating is not necessitated, and treating ability is advantageously enhanced.

It is another object of the present invention to provide a dry and crush treating apparatus wherein it is possible to cope with a request at a location where the request and needs are offered at and from the location, in case the apparatus is made into and mounted on an vehicle.

To achieve the object, according to a first aspect of the present invention, there is provided a dry and crush treating apparatus wherein a recovering unit such as a cyclone is disposed within a treating tank.

More specifically, the dry and crush treating apparatus using a jet burner, comprising: a jet burner drying an oil-containing or/and water-containing raw material; a dry treating tank; and a recovering unit recovering a dried fine particles made of the raw material, wherein the recovering unit is installed within the dry treating tank.

According to a second aspect of the present invention, there is provided a method of causing dry treatment to be performed by means of a revolving flow around the recovering unit and continuing the occurrence of this revolving flow to thereby separate and recover solid fine particles from the resulting gas flow.

More specifically, the dry and crush treating method using a jet burner, comprising the steps of: drying an oil-containing or/and water-containing raw material by a jet burner; causing a revolving flow of a fluid mixture comprised of the raw material by combustion gas from the jet burner around a recovering unit recovering dried fine particles made of the raw material, the recovering unit disposed in a dry treating tank; drying and crushing the raw material to make solid fine particle, thereby causing the solid fine particles to be floated and separated within the revolving gas flow; recovering the solid fine particles from the revolving gas flow as dried fine particles into the recovering unit in such a manner that the revolving gas flow continues to be revolved in the same direction; and discharging the gas of the revolving gas flow from a discharging pipe.

According to a third aspect of the present invention, there is provided an apparatus construction wherein a dry treating tank having a recovering unit built therein or the like is disposed and loaded on a load-carrying platform of a vehicle to thereby provide an on-vehicle mounted type apparatus.

More specifically, the dry and crush treating apparatus, comprising: a jet burner unit having a fuel pump unit; a dry treating tank drying and treating a raw material supplied thereto by a connection with the jet burner unit; a recovering unit recovering dried fine particles, the recovering unit disposed within the dry treating tank; a raw material hopper unit for supplying the raw material to the dry treating tank by way of a raw material supply conveyor; a control board for controlling the fuel pump unit of the jet burner and the raw material supply conveyor; and a generator serving as a power supply such as that for the control board, wherein the dry and crush treating apparatus is disposed and loaded on a load-carrying platform of a vehicle.

In the present invention, the treating tank dry and crush part is disposed on the outside of the recovering unit such as a cyclone. Therefore, there is no drawback that heat radiation occurs from a separately placed recovering unit. And, since the treating temperature and the recovering unit side temperature are the same, it is possible to treat at a lowest treating temperature that is necessary for dry treatment, resulting in a decrease in the treating cost. In addition, since the treating tank and the recovering unit are made into an integrated construction, the apparatus as a whole can be simplified and the installation space can also be decreased. Further, by making the apparatus into an on-vehicle mounted type, it is possible to move out to a requested place as the necessity arises, whereby the apparatus has become serviceable.

Furthermore, in the present invention, since the dry and crush treating apparatus has been made into a structure wherein the dried fine particles recovering unit is disposed within the dry treating tank, the apparatus as a whole is advantageously simplified, the treating ability is advantageously enhanced, and, if the apparatus is made into an on-vehicle mounted type, it is possible to cope with the request of a requesting destination as the necessity arises. In other words, it is possible to cope with a request at a location where the request and needs are offered at and from the location, in case the apparatus is made into and mounted on an vehicle.

In other words, according to the present invention, pipings can be drastically reduced, structure of the apparatus can be simplified, extra over heating is not necessitated, and treating ability is advantageously enhanced.

BRIEF DESCRIPTION OF THE ACCOMPANYING DRAWINGS

The above and further objects and novel features of the present invention will more fully appear from the following detailed description when the same is read in conjunction with the accompanying drawings, in which.

DETAILED DESCRIPTION OF THE PREFERRED EMBODIMENTS

Figure 1:
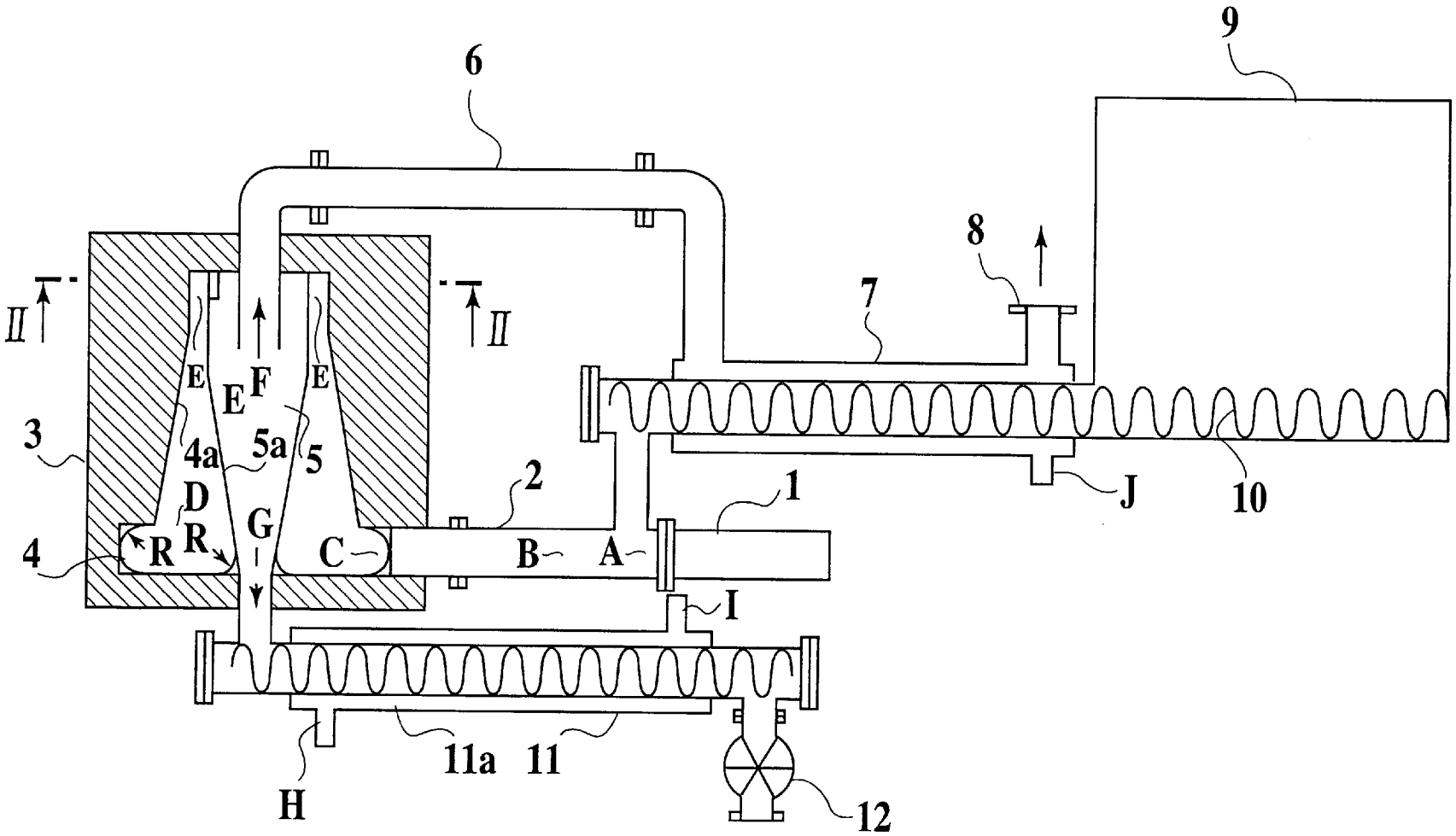
FIG. 1 is a constructional view illustrating an entire apparatus according to the present invention.

There will be detailed below the preferred embodiments of the present invention with reference to the accompanying drawings. Like members are designated by like reference characters.

Figure 2:
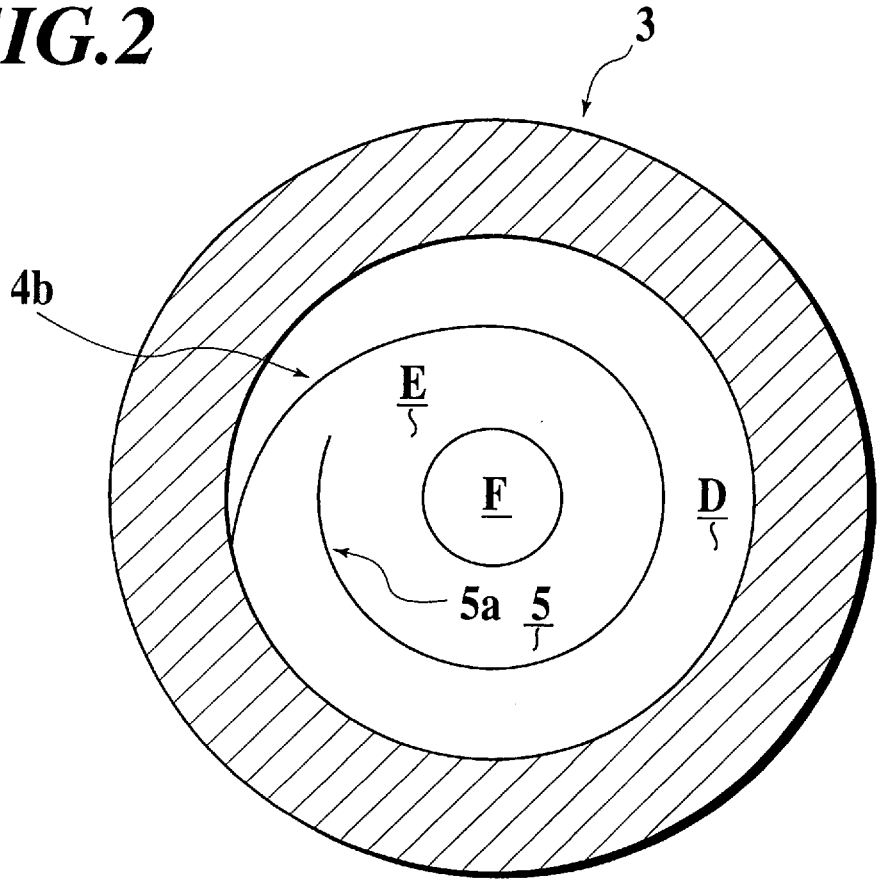
FIG. 2 is a sectional view taken along a line II—II of Fig.
Figure 3:
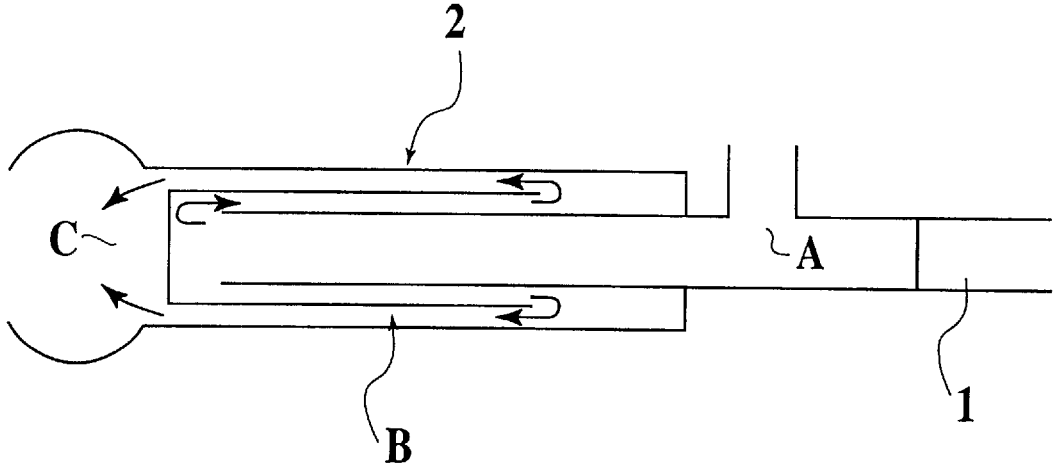
FIG. 3 is a sectional view illustrating a triplex pipe structure of a dispersing/heating/accelerating pipe of FIG. 1.

The embodiment of the present invention is illustrated in FIGS. 1 through 3 and the construction and operation of the apparatus will now be explained with reference to these figures.

A treatment raw material is thrown into a raw material hopper 9 and is sent toward a treating tank 3 by means of a raw material supply conveyor 10 installed at a bottom portion of it. The raw material is heated by a raw material pre-heating pipe 7 installed on the outside of the raw material supply conveyor 10. Into the raw material pre-heating pipe 7 there are introduced solid matter from a recovering unit discharge outlet F, jet burner combustion gas after separation thereof, and water vapor and oil vapor having generated due to the drying operation, by way of a discharge pipe 6. As a result of this, heat exchange is made between the discharge gas and the raw material, with the result that the raw material is heated and the discharge gas is cooled, whereby the oil vapor and water vapor are condensed and liquefied. If a spiral plate is attached to the outside of the raw material pre-heating pipe 7, the area for heat exchange is also increased with the result that the heat can be more efficiently recovered. If the temperature at the outlet of the raw material pre-heating pipe 7 is set to be 100° C. to 120° C., succeeding treatments (which will be described later) are mitigated because the oil/water vapors are for the most part condensed and liquefied. The heated raw material is wound at and into a jet burner raw material collision zone A within a dispersing/heating/accelerating pipe 2 by the attraction force in the vicinity of a nozzle of the high-temperature (1000 to 1300° C.) supersonic (1000 to 1300m/sec) jet stream generated by a jet burner 1 connected to and disposed on the dispersing/heating/accelerating pipe 2. During this wound-in period of time, it is dispersed and accelerated in a dispersing/heating/accelerating zone B. During this dispersed and accelerated period of time, the collision between the raw material particles/pieces and the collision thereof with the inner wall of the dispersing/heating/accelerating pipe 2 are repeated. During this repeated period of time, the raw material is crushed and heated, whereby water and oil start to be vaporized. Here, the raw material is dispersed and the surface area thereof is thereby increased, whereby the contact heat exchange with the combustion gas is performed. This starts to cause the performance of a very highly efficient drying operation. The dispersing/heating/accelerating pipe 2 is connected tangentially to the outer-peripheral portion C of a dry and crush portion provided on the outer side of the treating tank 3 interior. Accordingly, the raw material is introduced into the dry and crush part 4 within the treating tank 3 along with the jet burner combustion gas flow.

In the dry and crush part 4, while being repeatedly revolved at a high speed along with the combustion gas, the water and oil portions go on being heated and vaporized and are thereby separated from the solid matter. As a result, they go on revolving and rising as a flow of gas mixed with the combustion gas. On the other hand, whereas the solid matter having been changed into dried fine particles revolves and rises along the flow the gaseous mixture, coarse solid matter pieces are changed into fine particles due to mutual collision between the solid matter pieces, grinding thereof, collision thereof with the outer-peripheral surface, collision thereof with new solid matter pieces within the dry and crush part 4. The coarse solid matter pieces thus revolve and rise as in the case of the dried fine particles. Since the dry and crush part 4 is made into a tapered, i.e. inverted funnel-like, structure whose diameter (outside diameter) decreases toward the top, even when coarse particles have been erroneously jetted into it, they undergo a high magnitude of centrifugal force due to their great mass and they drop along an outer wall surface 4*a* to return to the dry and crush part 4 in which they are changed into fine particles.

And, in a separation zone D, the diameter on the outer side thereof decreases toward the upper part. Therefore, the centrifugal force $F=mv^2/r$. Assuming now that the revolution speed v be fixed, the outside radius r decreases toward the upper part and therefore the centrifugal force F becomes high in magnitude. Accordingly, in the separation zone D, the particles undergo the greater centrifugal force toward the upper part, whereby the conversion thereof to fine particles and the separation of the oil and water portions are promoted. As a result, the resulting fine particles and vapors rise by being mixed into the flow of the gaseous mixture. The gaseous mixture flows and solid matter fine particles which have revolved and risen are introduced while being revolved into the apex portion of a recovering unit 5 by advancing along a tangential plate 4*b* at the inlet E of the recovering unit. Due to the centrifugal force resulting from the revolution, the solid matter fine particles go down a funnel-shaped inner wall 5*a* of the recovering unit 5 because of their heavy weight while, on the other hand, the gaseous mixture flow is biased toward the center side because of its light weight and goes downward while being revolved and eventually turns to go up and is discharged from a discharge port F of the recovering unit. The solid matter fine particles go downward and are discharged from a lower recovered solid matter discharge port G. And the gaseous mixture flow is discharged finally into the atmosphere through a discharge gas discharging portion 8. The recovered solid matter is recovered from a rotary valve 12 by being passed through a solid matter recovering conveyor 11. In a case where it is needed to lower the temperature of the recovered material, it is sufficient to add a cooling mechanism 11 having a cooling water inlet H and a cooling water outlet I on the outside of the solid matter recovering conveyor 11 as illustrated in FIG. 1.

As the jet burner 1 used in the present invention, it is more preferable to use an air-cooled type jet burner than to use a water-cooled jet burner from the viewpoint of the thermal efficiency. Also, in a case where considering the installation of an on-vehicle mounted type jet burner treatment facility (which will be described later), it is very preferable to make up the apparatus according to this embodiment, i.e., an apparatus construction wherein the recovering unit is built in the treating tank because the construction is simplified and in addition because through the use of the air-cooled jet burner it is not only possible to enhance the thermal efficiency but it is also possible to omit the provision of a cooling water tank, cooling water pump and further a cooling water piping.

It is to be noted that if in FIG. 1 the discharge pipe 6 and raw material pre-heating pipe 7 are disposed in such a way that the outlet side of the gaseous mixture is made lower than the inlet side thereof or the outlet diameter is made larger than the inlet diameter, even when the water portion in the gas is dewed, the resulting water flows as a drain from a drain discharge port J and is likely to be discharged to the outside, with the result that convenience is given.

Also, in FIG. 1, with regard to the treatment in a succeeding stage of the discharge gas from the discharge gas discharging portion 8, if the discharge gas is watery, the treatment may be made in one stage. However, if the discharge gas is oily, the treatment will in some cases be made in multiple stages, for example, two or three stages.

Also, in FIG. 1, the solid matter (dried particles) recovering unit 5 is of a cyclone type that consists of a heat-resisting iron plate and is constructed of a member that is of an inverted taper, i.e. shaped like a funnel. It functions as a partitioning wall that partitions the interior of the treating tank 3 and that is made of a tapered, i.e. inverted funnel shaped heat-resisting iron plate. And the lower parts of the recovering unit 5 and separation zone D may have their angular portions R so rounded that the raw material in the gaseous mixture tangentially sent in cannot be adhered thereonto.

Further,in FIG. 1, the dispersing/heating/accelerating pipe 2 may be of a triplex type illustrated in, for example, FIG. 3. In a case where a sufficient length for dispersion/heating/acceleration cannot be given by a single-layer pipe in view of the installation space, or in a case where it is needed in view of the nature of the raw material (e.g. liquid raw material) to have a larger length of dispersion/heating/acceleration pipe, the pipe is made into a triplex pipe structure to thereby enhance the function thereof.

The apparatus that has been explained above is of a type wherein the dry treating tank 1 contains the solid matter recovering unit 5 and therefore the treatment can be done at a lowest treating temperature necessary for dry and crush treatment. In addition, the treating tank 1 has its interior also formed into a straight and tapered cylindrical shape, with the result that the treating tank 1 is easy to manufacture and simple in structure.

Figure 4:
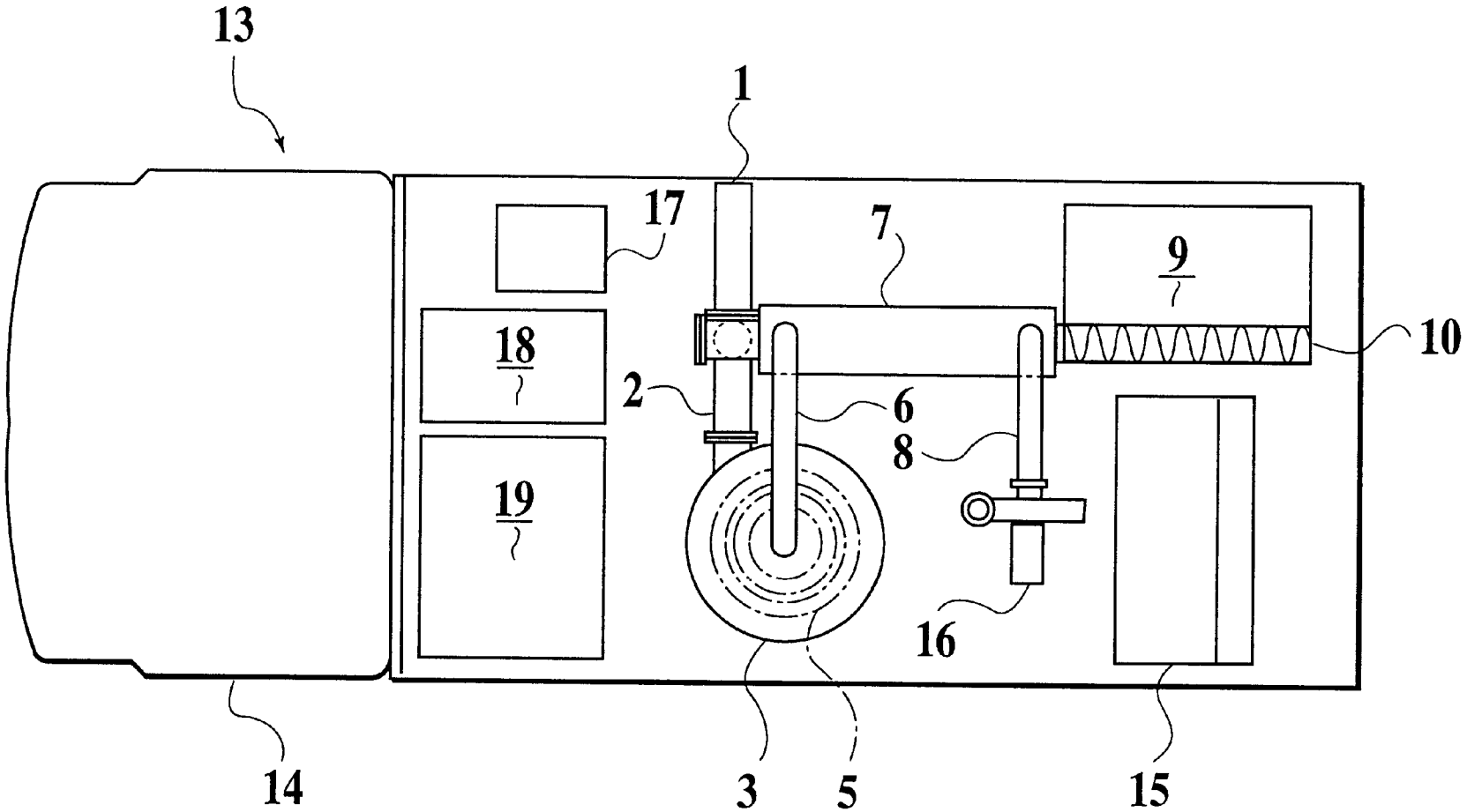
FIG. 4 is a plan view illustrating a truck where an on-vehicle mounted type dry and crush treating apparatus according to the present invention is disposed as an example.

Next, FIG. 4 is a plan view illustrating an example wherein a dry and crush treating apparatus is loaded on a load-carrying platform located rearwardly from a drivers cab 14 of a truck 13 to thereby make the apparatus into an on-vehicle mounted type.

Referring to FIG. 4, a treating tank 3 having a recovering unit 5 built therein is disposed at a substantially central part of the load-carrying platform. An air-cooling type jet burner 1 is connected thereto by means of a connection pipe 2. The jet burner 1 is connected through pipes or the like not illustrated to a fuel pump unit 17 and to a compressor 19 for compressing an air and is thereby constructed as a jet burner unit. A raw material in a raw material hopper 9 is supplied through a raw material pre-heating pipe 7 to the connection pipe 2 by way of a raw material supply conveyor 10 and these constituent elements are constructed as a raw material hopper unit. The discharge gas which has pre-heated the raw material is passed through a discharge gas discharging pipe 8 and discharged from a blower 16. At a rearward part of the platform there is disposed a control board 15 and at a forward part thereof there are disposed a generator 18 and compressor 19, whereby the control board 15 and generator 18 perform a control function for controlling a fuel pump unit 17, blower 16 and compressor 19 and a power supply function therefor, respectively.

In the case of an on-vehicle mounted type dry and crush treating apparatus, the height and area, i.e. space is limited. Therefore, the apparatus is made into a compact structure as illustrated in FIG. 4. In addition, by concurrent use of an air-cooled burner, it is possible to omit the provision of a supply equipment for supplying a cooling water and also to reduce the power consumption. Further, there is no heat radiation which would occur when a solid matter recovering unit has been separately placed and therefore it is possible to enhance the heat efficiency. As a result of this, the truck moves out as the necessity arises and can comply with a request for dry and crush treatment. It is to be noted that the on-vehicle mounted type apparatus becomes relatively large in size, a trailer may be used in place of the load-carrying platform.

An experimental example is shown below.

A test was conducted using a tanker sludge (a sediment on the bottom of a crude oil tanker) as a test piece for confirming the advantage of the present invention. The components of the tanker sludge are 20% of water portion, 10% of oil portion and 70% of solid matter portion. In the apparatus for executing the conventional method, wherein the recovering unit is separated from the treating tank, in order to prevent the re-dew of the covered solid matter and thereby make the percentage of oil content in the solid matter 1% or less, the treating temperature within the treating apparatus must be elevated up to 350° C. and the amount of raw material treated per unit of time was 132 Kg. However, in the apparatus of the present invention wherein the recovering unit is disposed within the treating tank, the percentage of oil content in the recovered solid matter portion can be made 1% or less at a treating temperature of 275° C. and the amount of raw material treated per unit of time (hour) was 156 Kg, with the result that there was exhibited a 18% increase in the amount of treatment. Similarly, in an apparatus wherein an air-cooled jet burner is concurrently used in the present invention, the amount of raw material treated per unit of time (hour) was 190 Kg at the same treating temperature of 275° C., with the result that a 44% increase in the amount of treatment was exhibited compared to the use of the recovering unit separated type water cooled Jet burner.

While preferred embodiments of the present invention have been described using specific terms, such description is for illustrative purposes, and it is to be understood that changes and variations may be made without departing from the spirit or scope of the following claims.

What is claimed is:

1. A dry and crush treating apparatus using a jet burner, comprising:

a jet burner drying an oil-containing or/and water-containing raw material;

a dry treating tank;

a dry and crush part which is mounted in the dry treating tank to receive the raw material from the jet burner and has an inverted funnel-shape so that relatively coarse particles in the raw material undergo a relatively high magnitude of centrifugal force and drop within the dry and crush part to be changed into relatively fine particles;

a recovering unit operative to receive material from the dry and crush part and to recover dried fine particles made of the raw material; and wherein the recovering unit is installed within the dry treating tank.

2. A dry and crush treating method using a jet burner, comprising the steps of:

drying an oil-containing or/and water-containing raw material by a jet burner;

causing a revolving flow of a fluid mixture comprised of the raw material by combustion gas from the jet burner around a recovering unit recovering dried fine particles made of the raw material, the recovering unit disposed in a dry treating tank;

drying and crushing the raw material to make solid fine particle in a dry and crush part which is made into an inverted funnel-shape and which is disposed in the dry treating tank, thereby causing the solid fine particles to be floated and separated within the revolving gas flow;

recovering the solid fine particles from the revolving gas flow as dried fine particles into the recovering unit in such a manner that the revolving gas flow continues to be revolved in the same direction; and discharging the gas of the revolving gas flow from a discharging pipe.

3. A dry and crush treating apparatus, comprising:

a jet burner unit having a fuel pump unit;

a dry treating tank drying and treating a raw material supplied thereto by a connection with the jet burner unit;

a dry and crush part which is made into an inverted funnel-shape and which is disposed in the dry treating tank;

a recovering unit operative for recovering dried fine particles, the recovering unit being disposed within the dry treating tank;

a raw material hopper unit for supplying the raw material to the dry treating tank by way of a raw material supply conveyor;

a control board for controlling the fuel pump unit of the jet burner and the raw material supply conveyor;

a generator serving as a power supply to supply power to the control board; and wherein the dry and crush treating apparatus is disposed and loaded on a load-carrying platform of a vehicle.

* * * * *